US006318853B1

(12) United States Patent
Asano et al.

(10) Patent No.: US 6,318,853 B1
(45) Date of Patent: Nov. 20, 2001

(54) IMAGE FORMING APPARATUS HAVING INTERMEDIATE MEDIUM

(75) Inventors: Takeshi Asano, Toyoake; Naoki Katayama, Kariya, both of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/398,458

(22) Filed: Sep. 17, 1999

(30) Foreign Application Priority Data

Sep. 30, 1998 (JP) ..... 10-294650

(51) Int. Cl.[7] ..... B41J 2/01

(52) U.S. Cl. ..... 347/103; 347/105; 347/101; 347/102

(58) Field of Search ..... 347/101, 102, 347/103, 105

(56) References Cited

U.S. PATENT DOCUMENTS 5,372,852 * 12/1994 Titterington et al. ..... 347/103
5,817,205 * 10/1998 Kaule ..... 156/233
6,068,372 * 5/2000 Rousseau et al. ..... 347/103
6,196,675 * 3/2001 Deily et al. ..... 347/103

FOREIGN PATENT DOCUMENTS

11174887-A * 7/1999 (JP) ..... G03G/15/20

* cited by examiner

*Primary Examiner*—John Barlow
*Assistant Examiner*—Manish S. Shah
(74) *Attorney, Agent, or Firm*—Oliff & Berridge, PLC

(57) ABSTRACT

An ink jet head unit is provided above a rotating intermediate transfer device such that nozzle surfaces face to the intermediate transfer device. A release oil jet head and a blade are provided on the upstream side of the ink jet head unit relative to the direction of rotation. Fine oil is ejected from the release oil jet head onto the intermediate transfer device and the fine oil is smoothed using a tip of the blade. Since the release oil is ejected using the ink jet method, the most suitable thickness of release oil film can be formed by controlling the area and the amount of the application. As a result, evenly transferred high quality images can be obtained.

20 Claims, 7 Drawing Sheets

IMAGE FORMING APPARATUS HAVING INTERMEDIATE MEDIUM

BACKGROUND OF THE INVENTION

1. Field of Invention

The invention relates to an image forming apparatus including an intermediate medium, wherein an image is first formed on the intermediate medium by ink jet heads using phase-changeable ink, and then transferred onto a recording medium, more particularly, release oil is applied on the intermediate medium before the phase-changeable ink is ejected.

2. Description of Related Art

An ink jet printer, shown in FIG. 7, is known as the image forming apparatus described above, for example. FIG. 7 shows a schematic diagram of the main structure of the ink jet printer 80.

The ink jet printer 80 forms images using hot melt inks of yellow, magenta, cyan, and black. The ink jet printer 80 includes a drive roller 11, a following roller 12, an intermediate transfer belt 13, and a pair of sheet feed rollers 15.

The drive roller 11 is driven by a motor (not shown). The following roller 12 is provided opposite to and separate from the drive roller 11. The intermediate transfer belt 13 is wound around and spans between the drive roller 11 and the following roller 12. The sheet feed rollers 15 are disposed below the intermediate transfer belt 13 to feed a sheet P.

The ink jet head unit 20 is provided above the intermediate transfer belt 13 and includes an yellow head 21, a magenta head 22, a cyan head 23, and a black head 24, which eject yellow, magenta, cyan, and black colored inks respectively. The yellow head 21, the magenta head 22, the cyan head 23, and the black head 24 are provided above the intermediate transfer belt 13 such that their nozzle surfaces face to the intermediate transfer belt 13, and have nozzles which are oriented in the direction of the width of the intermediate transfer belt 13, that is they are line heads. Hot melt ink is ejected from each head onto the intermediate transfer belt 13 so that the color image is formed on the intermediate transfer belt 13.

A transfer roller 16 is disposed under the intermediate transfer belt 13 and, above the transfer roller 16, a heat roller 17 is provided opposite to the transfer roller 16 with the intermediate transfer belt 13 passing therebetween. The transfer roller 16 is movable in a direction indicated by an arrow F3 as the transfer roller 16 has a movement mechanism (not shown). On the left side of the transfer roller 16 is a separation pawl 18 provided for peeling the sheet S from the intermediate transfer belt 13. The separation pawl 18 is movable in a direction indicated by an arrow F4 as the separation pawl has a movement mechanism (not shown). A belt marker sensor 14 is provided on the left side of the ink jet head unit 20 in order to detect that the intermediate transfer belt 13 has reached a start position where an image is formed.

A silicon oil applying unit 90 is provided substantially below the following roller 12 and includes an oil tank 92 storing silicon oil 91 in which a felt 93 is soaked. The felt 13 is provided such that one end extends from an open mouth provided in the upper area of the oil tank 92 so as to contact the intermediate transfer belt 13. The upper end of the felt 93, contacting the intermediate transfer belt 13, has a width corresponding to the width of the intermediate transfer belt 13. A bracket 94 for a bolt is provided in the upper area of the oil tank 92 and a plate 95 is attached to the bracket 94 so as to be able to pivot. The upper end of the felt 93 is attached to a fore end of the plate 95 and an upper end of a coil spring 96 is attached to a rear end of the plate 95. A lower end of the coil spring 96 is connected to a plunger 98 of a solenoid 97.

When the ink jet printer 80 described above is turned on, the intermediate transfer belt 13 is transported by rotation of the drive roller 11. Then the solenoid 97 of the silicon oil applying unit 90 is driven so that the plunger 98 is pulled downward. As a result, the plate 95 pivots in the counter-clockwise direction, as shown in FIG. 7, so that the end of the felt 93 is pushed against the intermediate transfer belt 13. In this way, silicon oil that soaks into the felt 93 is applied to the surface of the intermediate transfer belt 13. Because the width of the upper end of the felt 93 corresponds to the width of the intermediate transfer belt 13 as described above, silicon oil 91 is applied to the entire area of the intermediate transfer belt 13.

When the belt marker sensor 14 detects that the intermediate transfer belt 13 has reached a start position where an image is formed, the ink jet head unit 20 is driven and hot melt ink is ejected from the yellow head 21, the magenta head 22, cyan head 23, and black head 24, as appropriate, onto the intermediate transfer belt 13. In this way, a color image using hot melt inks is formed on the silicon oil applied to the intermediate transfer belt 13.

Then a sheet P is fed from a cassette (not shown) included in the ink jet printer 10 toward the sheet feed rollers 15, and further transported toward the transfer roller 16 by the sheet feed rollers 15. The time when the sheet P reaches an image forming position at the transfer roller 16 and the time when an edge of the image formed on the intermediate transfer belt 13 reaches the transfer roller 16 are controlled so as to be synchronized. The transfer roller 16 moves in a direction indicated by the arrow F3 to press the sheet P against the intermediate transfer belt 13. At that time, hot melt ink comprising the image on the intermediate transfer belt 13 is heated by the heat roller 17 and becomes soft. At the same time the softened hot melt ink is transferred onto the sheet P by the pressure of the transfer roller 16.

Then the sheet P is peeled from the intermediate transfer belt 13 by the separation pawl 18, which moves in the direction indicated by the arrow F4, and is discharged onto a tray (not shown).

However, as described above, because the silicon oil 91 applying unit 90, provided with the ink jet printer 10, must apply the silicon oil 91 to the entire area of the intermediate transfer belt 13, it can not apply the silicon oil 91 to only a specific area of the intermediate transfer belt 13.

Moreover, the thickness of the silicon oil film can not be controlled because the pressure with which the end of the felt 93 presses the intermediate transfer belt 13 is determined by the force of the coil spring 96 so that the pressure is not constant.

Furthermore, the felt 93 gets dirty ink as a result of remaining in contact with the surface of the intermediate transfer belt 13. In particular, the felt 93 gets stopped up with the ink leftover with intermediate transfer belt 13 so that silicon oil 91 can not be applied onto the intermediate transfer belt 13 evenly. Therefore, some parts of the hot melt ink do not come off completely and transfer precision declines.

As described above, the previous ink jet printer 10 is not capable of controlling the area to which silicon oil 91 is applied, the thickness of the silicon oil film, and the application of the silicon oil 91 evenly.

SUMMARY OF THE INVENTION

It is an object of the invention to provide an image forming apparatus which is capable of controlling the area where silicon oil is applied and the thickness of the silicon oil film as well as being capable of applying the silicon oil evenly.

In order to achieve the above and the other objects, an image forming apparatus comprises ink jet heads that eject hot melt inks; an intermediate medium on which is formed an ink image composed of hot melt ink ejected from the ink jet heads onto the surface thereof; and a transfer unit that transfers the image formed on the intermediate medium onto a recording medium, wherein a release oil jet head that ejects release oil on the intermediate medium where an image is to be formed is provided without contacting with the surface of the intermediate medium and the ink jet heads are structured to eject hot melt ink over the release oil.

That is, the release oil jet head ejects the release oil using an ink jet method so that the oil application area can be controlled. Moreover, release oil film to be formed on the intermediate medium can be always even because the release oil jet head does not contact with the intermediate medium. Thus, any ink remaining on the intermediate medium does not adhere to the nozzle of the release oil jet head and ejecting failure does not happen.

Furthermore, a head whose structure is the same as that of the ink jet head unit 20 can be used for the release oil jet head 30 so that driving system and attachments can be used commonly and the ink jet printer can be produced easily.

When the fine oil, ejected from the release oil jet head, is attached to the intermediate medium, it expands immediately and forms a release oil film. However, there will be uneven areas on the oil film because the fine oil is not uniform at areas where ejection drops meet each other. At those areas, hot melt ink will not be transferred onto the recording medium completely and clearly so that transferred image will appear faded.

In order to avoid this, in one aspect of the invention, the image forming apparatus further comprises a smoother that smoothes the release oil ejected from the release oil jet head on the intermediate medium. Therefore, the film thickness can always be even so that hot melt ink is transferred onto the recording medium stably and the quality of image can be improved.

According to another aspect of the invention, the image forming apparatus, the smoother is a blade having the tip that contacts with the surface of the intermediate medium. Therefore, oil can be transferred from thick film area to thin film area so that thickness of the oil film can be always even.

According to other aspect of the invention, the image forming apparatus further comprises an oil application control unit that controls the application amount of release oil ejected from the release oil jet head, so that the thickness of the release oil film formed on the intermediate medium can be controlled.

According to a further aspect of the invention, the oil application control unit, of the image forming apparatus, comprises an ink application calculation unit that calculates the amount of hot melt ink ejected from the ink jet heads in order to control the application amount of release oil based on the calculation result of the ink amount by the ink application calculation unit.

That is, even when the ejection amount of hot melt ink (the amount of image data) to be ejected onto the intermediate medium is changed, a most suitable amount of release oil can be ejected on the intermediate medium automatically.

For example, even when both image data and text data exist on a page, when image data includes dark color area and light color area or when the amount of text data is quite different by area, the most suitable amount of the release oil can be ejected onto the intermediate medium automatically.

Therefore, an insufficient supply or an oversupply of release oil does not happen so that all the hot melt ink comes off the intermediate medium or is not changed in color tone. As a result, the quality of the image can be improved.

According to a still further aspect of the invention, the image forming apparatus, wherein the oil application control unit comprises a switch that controls the application amount of release oil to be ejected from the release oil jet head so that the application amount can be manually adjusted to the most suitable amount for the data.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Figure 1:
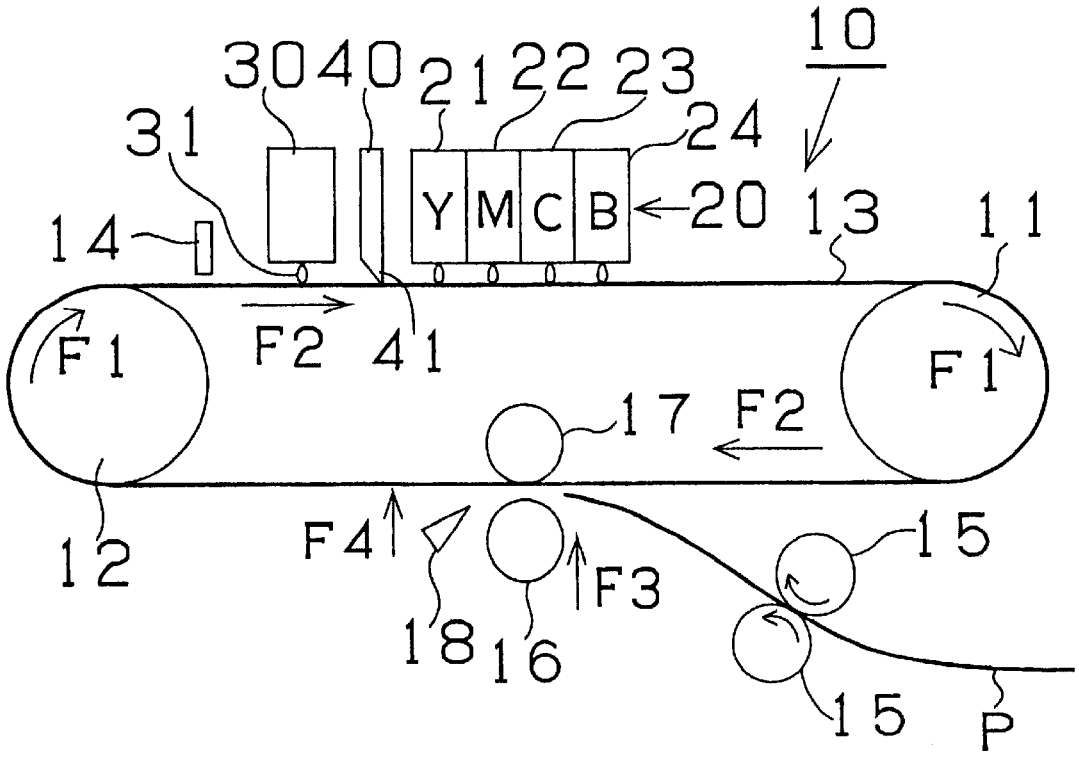
FIG. 1 is a schematic diagram showing the main structure of an ink jet printer according to a first embodiment of the invention.

An ink jet printer according to a first embodiment of the invention will be described while referring to the drawings.

Figure 7:
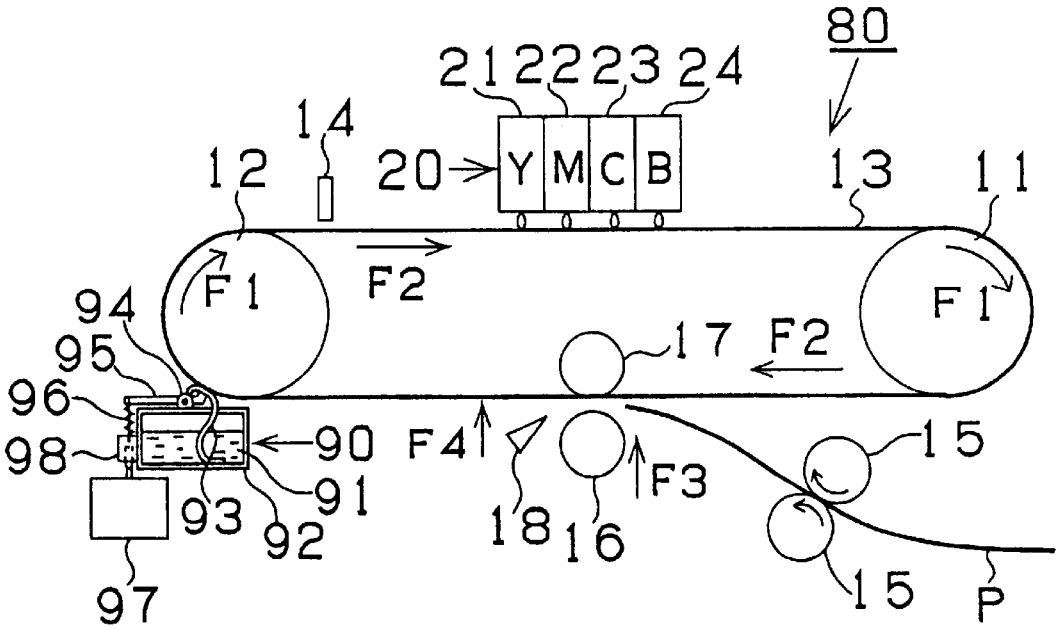
Fig.7 RELATED ART
FIG. 7 is a schematic diagram showing the main structure of the related art ink jet printer.

For the ink jet printer of the invention, an intermediate transfer belt is used for example. The ink jet printer of the invention has some structures similar to the ink jet printer, shown in FIG. 7, so that the same symbols will be used in the figures for the ink jet printer of the invention and an explanation for the similar structures are omitted.

FIG. 1 shows a schematic diagram of the main structure of an ink jet printer 10 according to the first embodiment of the invention.

On the upstream (left side in FIG. 1) side of an ink jet head unit 20 included in the ink jet printer 10, a release oil jet head 30 is provided such that the nozzle surfaces face the intermediate transfer belt 13. The release oil jet head 30 is an ink jet type head that is of the same type as the ink jet heads 21–23 of the ink jet head unit 20. The release oil jet head 30 ejects fine oil 31 toward a surface of the intermediate transfer belt 13.

A blade 40 is provided between the release oil jet head 30 and the ink jet head unit 20. An acute angled tip 41 of the blade 40 contacts the surface of the intermediate transfer belt 13. The blade 40 spreads the fine oil 31 ejected by the release oil jet head 30 smoothly to form an even oil film on the intermediate transfer belt 13.

Figure 2A:
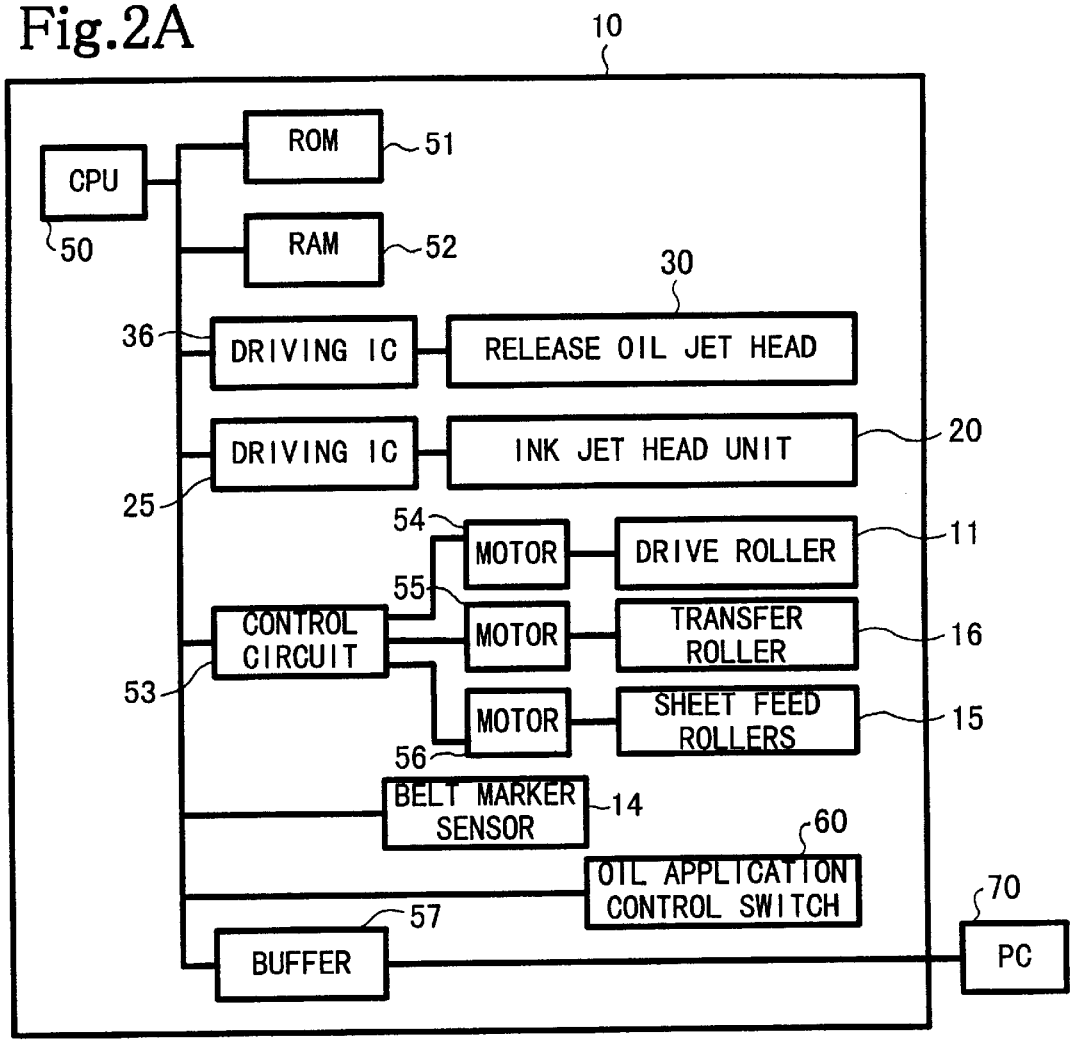
FIG. 2A is a block diagram showing the electrical structures the ink jet printer.

The electrical structure of the ink jet printer 10 will be described with reference to FIG. 2A.

CPU 50 is installed in the inkjet printer 10 to control the ink jet head unit 20, the release oil jet head 30, a drive roller 11, a transfer roller 16, and sheet feed rollers 15. Moreover, ROM 51, RAM 52, a driving IC 36, a driving IC 25, a control circuit 53, a belt marker sensor 14, an oil application control switch 60, and a buffer 57 are connected to CPU 50.

A computer program for performing each control described above is held in ROM 51. RAM 52 temporarily stores the computer program which is read from ROM 51. The driving IC 36 drives the release oil jet head 30 and the driving IC 25 drives the ink jet heads 21–23 of the ink jet head unit 20. Motors 54, 55, 56 are controlled by the control circuit 53. The oil application control switch 60 is provided for changing the application amount of release oil from the release oil jet head 30. The buffer 57 temporarily stores image data from a computer 70.

The motors 54, 55, 56 drive the drive roller 11, the transfer roller 16, and the sheet feed rollers 15, respectively.

The structure of the oil application control switch 60 will be described with reference to FIGS. 2B and 2C.

Figure 2B:
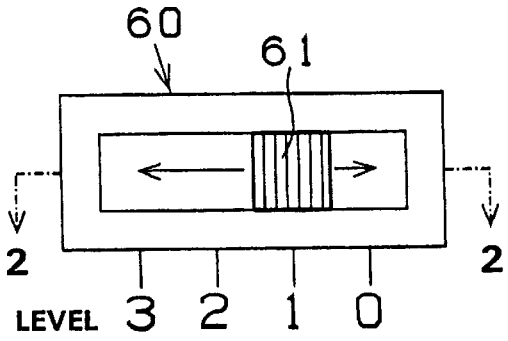
FIG. 2B is an explanatory diagram showing the oil application control switch.
Figure 2C:
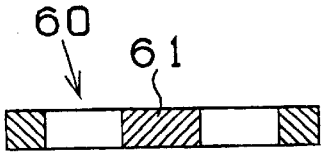
FIG. 2C is a view in cross section taken along line 2—2 of the oil application control switch described in FIG. 2B.

FIG. 2B is a diagram of the oil application control switch 60 and FIG. 2C is a view along line 2—2 of the oil application control switch 60 shown in FIG. 2B.

The oil application control switch 60 is structured as DIP switch type and includes a slide 61 which can slide in a direction indicated by the arrows in FIG. 2B. The application amount of the oil application control switch 60 can be changed from level 0 to level 3 by sliding the slide 61.

In this embodiment the release oil jet head 30 does not eject the release oil when the slide 61 is adjusted to the level 0. The application amount of release oil depends on the level, with the amount increasing as the level number is increased. For example, the slide 61 is adjusted to the level 1 for text data, the level 2 for regular image data, and the level 3 for image data having a solid area. The application amount of release oil is selected such that the pulse rate of the driving signal which drives the release oil jet head 30 is changed.

Next, operations performed by the ink jet printer 10 will be described with reference to FIGS. 3–5D.

Figure 3:
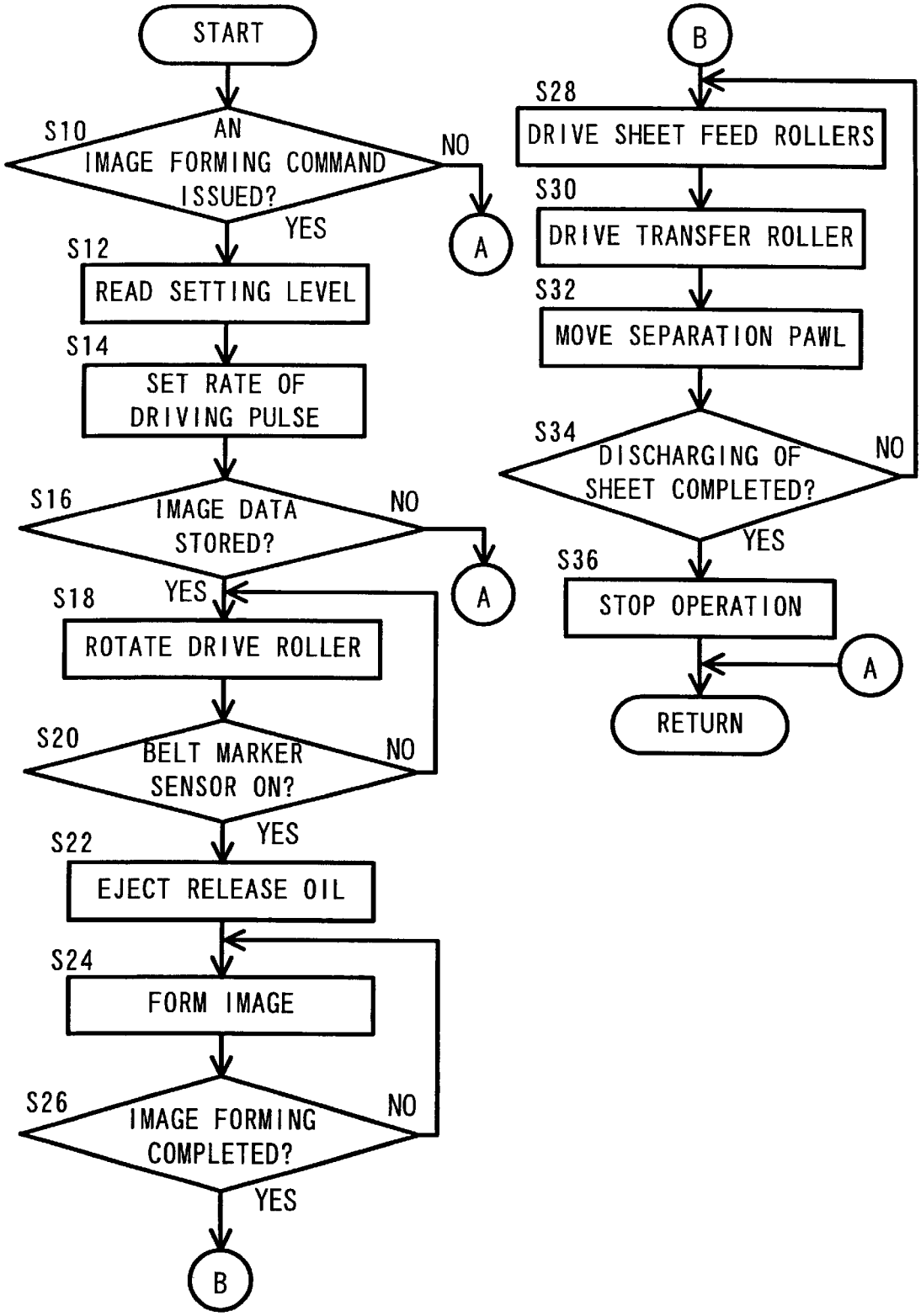
FIG. 3 is a flowchart representing the control executed by a CPU.
Figure 4:
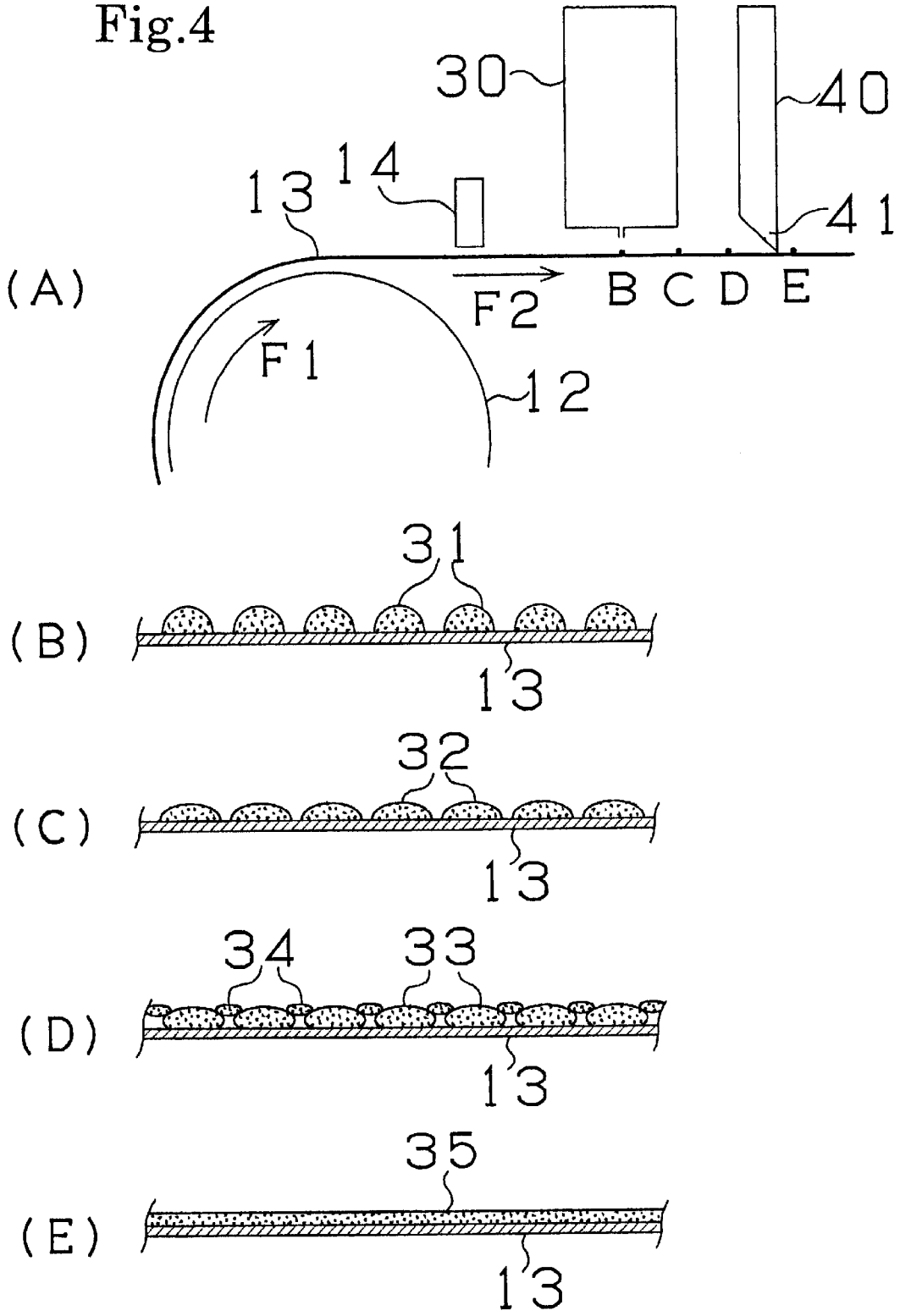
FIG. 4A is an explanatory diagram showing a part of the ink jet printer where a release oil jet head is provided.
FIG. 4B is a diagram showing the condition of the fine oil at a point indicated in FIG. 4A.
FIG. 4C is a diagram showing the condition of the fine oil at a second point indicated in FIG. 4A.
FIG. 4D is a diagram showing the condition of the fine oil at a third point indicated in FIG. 4A.
FIG. 4E is a diagram showing the condition of the fine oil at a fourth point indicated in FIG. 4A.
Figure 5:
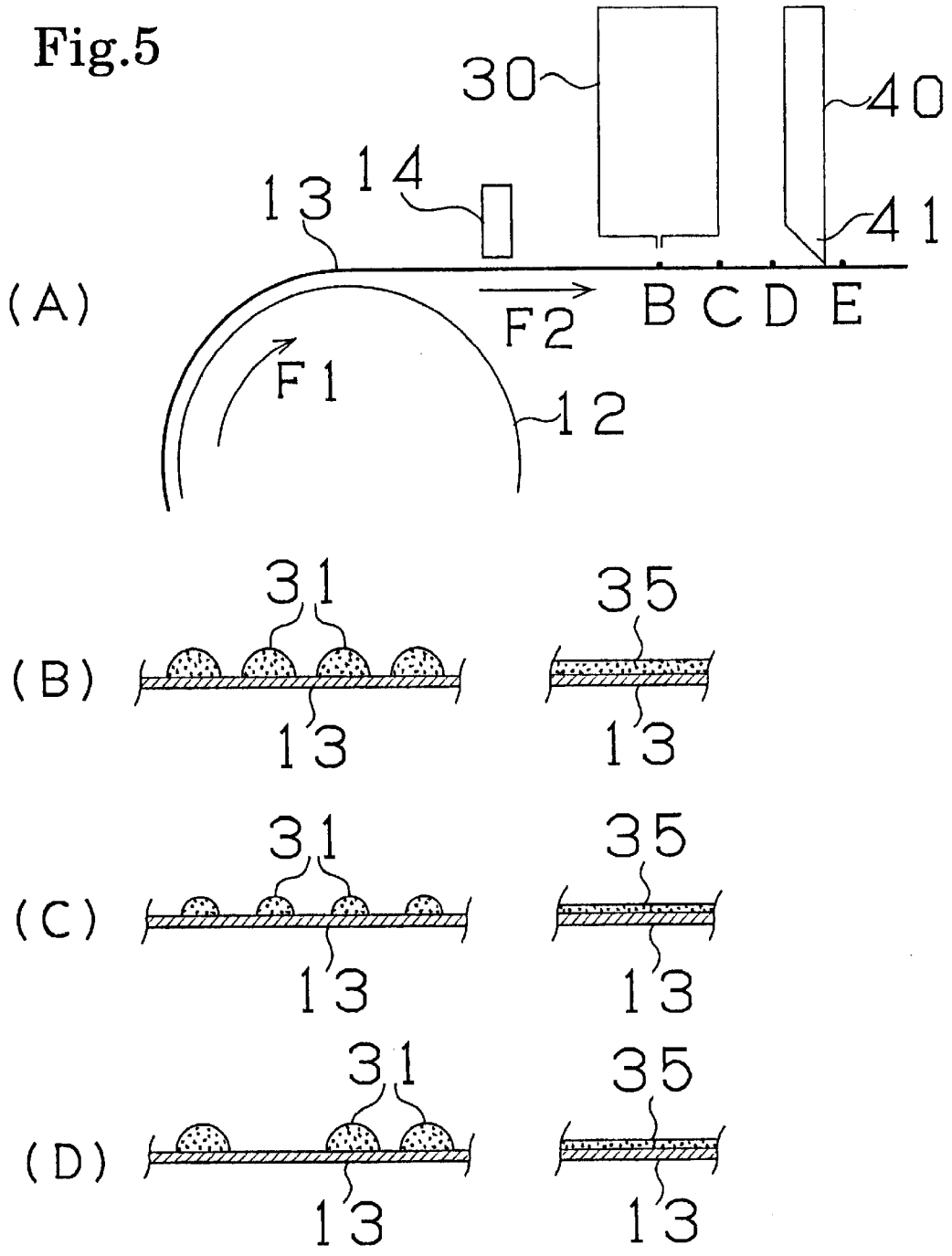
FIG. 5A is an explanatory diagram showing a part of the ink jet printer where a release oil jet head is provided.
FIG. 5B is a diagram showing the condition of the fine oil at a first point and the release oil film at a fourth point indicated in FIG. 5A when application amount of release oil is large.
FIG. 5C is a diagram showing the condition of the fine oil at a first point and the release oil film at a fourth point indicated in FIG. 5A when application amount of release oil is little.
FIG. 5D is a diagram showing the condition of the fine oil at a first point and the release oil film at a fourth point indicated in FIG. 5A when the ejection of release oil is curtailed.

FIG. 3 is a flowchart of the control by CPU 50. FIG. 4A is a diagram of a part of the ink jet printer where the release oil jet head 30 is provided, FIG. 4B shows the condition of the fine oil at point B indicated in FIG. 4A, FIG. 4C shows the condition of the fine oil at point C indicated in FIG. 4A, FIG. 4D shows the condition of the fine oil at point D indicated in FIG. 4A, and FIG. 4E shows the condition of the fine oil at point E indicated in FIG. 4A.

FIG. 5A is a plan view showing an explanatory diagram of a part of the ink jet printer where the release oil jet head 30 is provided, FIG. 5B shows the condition of the fine oil at point B and release oil film at point E indicated in FIG. 5A when the application amount of release oil is large, FIG. 5C shows the condition of the fine oil at point B and release oil film at point E indicated in FIG. 5A when the application amount of release oil is small, and FIG. 5D shows the condition of the fine oil at point B and release oil film at point E indicated in FIG. 5A when the ejection of release oil is curtailed.

First, when the CPU 50 receives an order to form an image from the computer 70 (Step 10 (S stands for step hereinafter):Yes), the CPU 50 registers the setting level on the oil application control switch 60 (S12), and then the driving pulse rate is set based on the setting level (S14). When the CPU 50 detects that image data, from the computer 70, is stored in the buffer 57 (S16:Yes), CPU 50 outputs the driving signal for the motor 54 to the control circuit 53 in order to rotate the drive roller 11 so that the intermediate transfer belt 13 is transported (S18).

Then, when the belt marker sensor 14 detects the intermediate transfer belt 13 has reached a start position where an image is formed (S20:Yes), the CPU 50 outputs the driving signal of driving pulse rate which is set at Step 14 to the driving IC 36 to drive the release oil jet head 30 (S22).

As a result, the fine oil 31 is ejected from the release oil jet head 30 onto the intermediate transfer belt 13 so that hemisphere shaped fine oil 31 is applied to the intermediate transfer belt 13 as shown in FIG. 4B. When the fine oil 31 has reached point C in FIG. 4A, the fine oil 31 has a shape that has flattened as shown in FIG. 4C. When the fine oil 32 reaches the point D in FIG. 4A, the fine oil 32 has changed shape so it is flat with diameter 33 broad and narrow diameter 34 droplets as shown in FIG. 4D.

The fine oil 33, 34 droplets are smoothed by the tip 41 of the blade 40 so that they become an even release oil film 35 at the point E in FIG. 4A as shown in FIG. 4E. During ejection, when the setting level on the oil application control switch 60 is high, big drops of fine oil 31 are ejected onto the intermediate transfer belt 13 as shown in FIG. 5B (left) and a thick release oil film 35 is formed as shown in FIG. 5B (right).

When the setting level on the oil application control switch 60 is low, small drops of fine oil 31 are ejected onto the intermediate transfer belt 13 as shown in FIG. 5C (left) and a thin release oil film 35 is formed as shown in FIG. 5C (right).

Alternatively, normal drops of the fine oil can be ejected but the number is reduced, as shown in FIG. 5D (left) to obtain a thin release oil film 35 as shown in FIG. 5D (right).

Then the CPU 50 outputs the image data stored in the buffer 57 to the driving IC 25 to drive the ink jet head unit 20, and the intermediate image is formed onto the image forming area of the intermediate transfer belt 13 (S24). After that, when the CPU 50 detects the completion of the image forming (S26:Yes), the CPU 50 outputs the driving signals for driving the motors 55, 56 to the control circuit 53 in order to drive the sheet feed rollers 15 and the transfer roller 16 (S28 and S30). Then the image formed on the intermediate transfer belt 13 is then transferred onto the sheet P.

At that time, because the even release oil film 35 is formed by the release oil jet head 30 between the surface of the intermediate transfer belt 13 and hot met ink (refer to FIG. 4E), the image on the intermediate transfer belt 13 is evenly transferred onto the sheet P.

Moreover, since the application amount of release oil is adjusted to the most suitable amount by the oil application control switch 60, the application amount is just enough to transfer an image without retaining any of the image on the intermediate transfer belt 13 or changing the color tone of the image.

Then the separation pawl 18 is moved in the direction indicated by the arrow F4 (FIG. 1) in order to peel the sheet P from the intermediate transfer belt 13 under the control of the CPU 50 (S32). After that, when the CPU 50 detects that the sheet P is discharged and printing is completed (S34), the operation is stopped (S36).

As described above, when the ink jet printer 10 of the first embodiment is used, the thickness of the release oil film 35 can be controlled because the release oil is ejected using an ink jet method.

Further, the application amount of release oil can be controlled so as to be just enough to transfer an image without retaining any of the image on the intermediate transfer belt 13 or changing the color tone of image because the application amount is adjusted to the most suitable amount, by the oil application control switch 60, according to the amount of image data.

Also, the transfer precision of the image can be improved because the thickness of the release oil film 35 is evened out using the blade 40 which makes the fine oil 31 ejected from the release oil jet head 30 smooth.

Moreover, the release oil film 35 formed on the intermediate transfer belt 13 can be always even because the release oil jet head 30 does not contact with the intermediate transfer belt 13 so that retained ink on the intermediate transfer belt 13 does not adhere to the nozzle of the release oil jet head 30 and release oil ejecting failure does not occur.

Furthermore, a head whose structure is the same as that of the ink jet head unit 20 can be used for the release oil jet head 30 so that the driving system and attachments can be used commonly and the ink jet printer can be simply structured.

Figure 6:
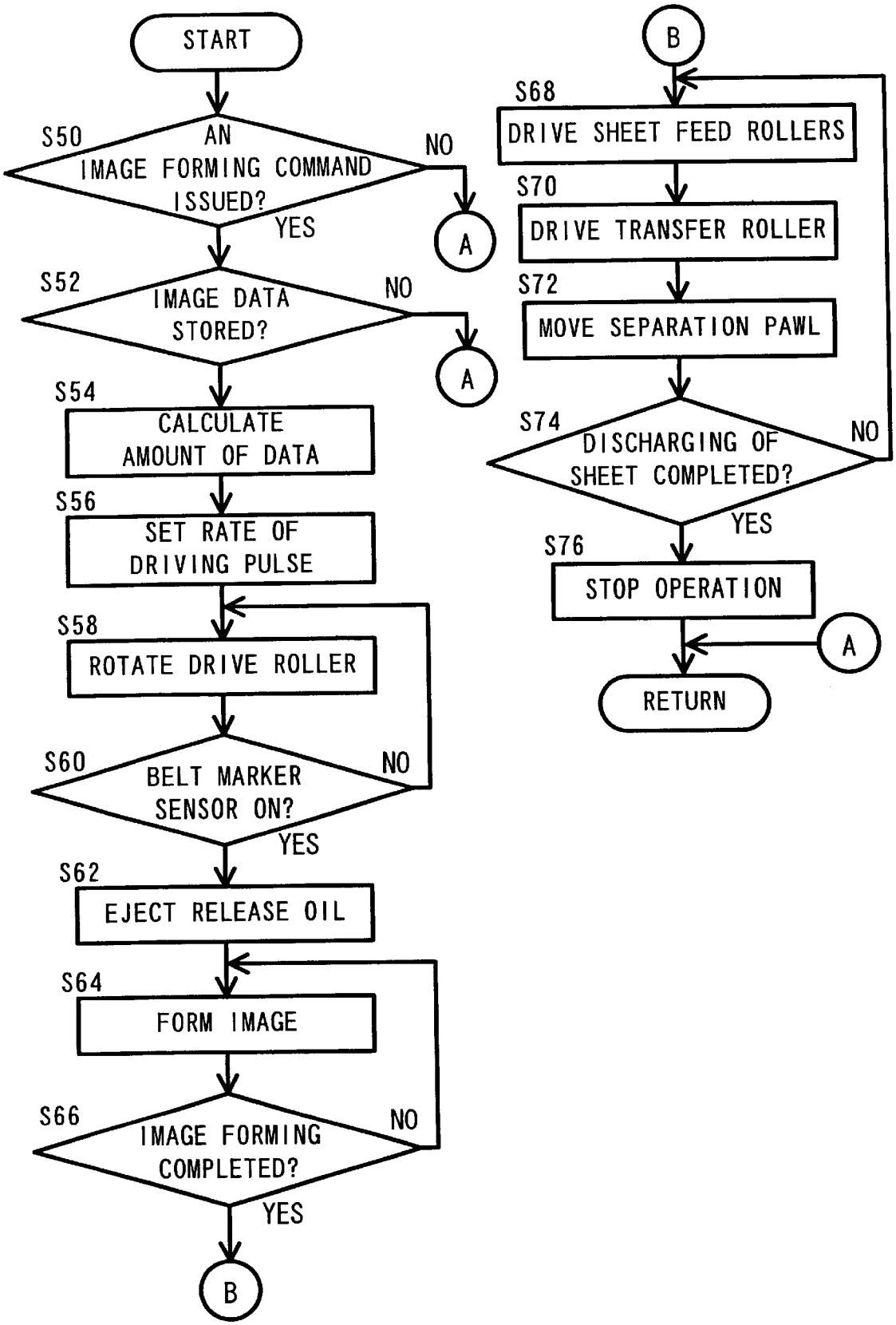
FIG. 6 is a flowchart representing a control of the CPU according to a second embodiment of the invention.

Next, an ink jet printer according to a second embodiment of the invention will be described with reference to FIG. 6.

The ink jet printer according to the second embodiment can control the application amount of release oil ejected based on a calculation result of the amount of image data.

The structure and operations performed by ink jet printer according to the second embodiment are almost the same as the ink jet printer according to the first embodiment, except for a part of the control by the CPU 50, therefore, the control by the CPU 50 will be described below. A driving pulse rate table (not shown) with correspondence of the amount of image data and the rate of driving pulse is assumed to be stored in ROM 51.

The CPU 50 receives an order to form an image (S50:Yes). When the CPU 50 detects that an image data is stored in the buffer 57 (S52:Yes), the amount of image data is calculated per sheet or raster (S54). Then a driving pulse rate equivalent to the calculated image amount is selected from the driving pulse rate table in ROM 51 and set (S56).

After that, the CPU 50 performs the same control at Steps 58 through 76 as the control at Steps 18 through 36 performed on the ink jet printer according to the first embodiment.

As described above, when the ink jet printer 10 of the second embodiment is used, the most suitable amount of the release oil can be ejected from the release oil jet head 30 because the application amount can be controlled based on the calculation result of the amount of the image data. In particular, even when both image data and text data exist on a page, when image data includes dark color area(s) and light color area(s) or when the amount of text data is quite different by area, the most suitable amount of the release oil can be ejected from the release oil jet head 30 onto the intermediate transfer belt.

Therefore, an insufficient supply or an oversupply of the release oil does not happen so that hot melt ink is prevented from being retained on the intermediate transfer belt 13 or being changed in color tone. As a result, the quality of the image can be improved.

In addition, since the application amount of the release oil can be changed automatically based on the amount of image data, the unconvenience that the level of the oil application control switch 60 must be manually changed each time, as with the ink jet printer of the first embodiment, can be avoided.

Moreover, the driving signal which drives the ink jet head unit 20 can be used to drive the release oil jet head 30.

For example, the ink jet printer 1 including the fixed blade 40 was described in each embodiment above. However, the ink jet printer could have a movable blade 40, that is, a unit (blade moving unit) that moves the blade 40 up and down (away and, respectively, toward), with respect of the intermediate transfer belt 13. The blade moving unit moves the blade 40 downward so that the tip 41 of the blade 40 is contacted with the intermediate transfer belt 13 as necessary.

Also, for example, the ink jet printer having the intermediate transfer belt 13 as an intermediate medium was described, however an ink jet printer having a intermediate transfer drum as the intermediate medium can be used.

What is claimed is:

1. An image forming apparatus, comprising:

a plurality of ink jet heads, each ink jet head ejecting hot melt ink;

an intermediate medium having formed thereon an ink image using the hot melt ink ejected from each of the ink jet heads on the surface thereof;

a transfer unit that transfers the image formed on the intermediate medium onto a recording medium; and a release oil jet head, that ejects release oil onto the intermediate medium where an image is to be formed, is positioned upstream of the ink jet heads relative to a direction of movement of the intermediate medium such that the ink jet heads eject hot melt ink over the release oil deposited on the intermediate medium.

2. The image forming apparatus according to claim 1, further comprising a smoother that smoothes the release oil ejected from the release oil jet head on the intermediate medium.

3. The image forming apparatus according to claim 1, further comprising an oil application control unit that controls the application amount of release oil ejected from the release oil jet head.

4. The image forming apparatus according to claim 3, wherein the control unit controls the application amount of release oil ejected from each ejection nozzle of the release oil jet head.

5. The image forming apparatus according to claim 3, wherein the control unit controls which ejection nozzles of the release oil jet head eject release oil to obtain the application amount of release oil.

6. The image forming apparatus according to claim 1, wherein the oil application control unit comprises an ink application calculation unit that calculates the amount of hot melt ink ejected from the ink jet heads in order to control the application amount of release oil based on the calculation result of the ink amount by the ink application calculation unit.

7. The image forming apparatus according to claim 1, wherein the smoother is a blade having the tip that contacts with the surface of the intermediate medium.

8. The image forming apparatus according to claim 1, wherein the oil application control unit comprises a switch that controls the application amount of release oil to be ejected from the release oil jet head.

9. A method of printing using heat sensitive inks, comprising the steps of:

determining whether there is data to be printed;

establishing the amount of data to be printed;

moving an intermediate medium to a predetermined position;

ejecting release oil onto the intermediate medium as it transits to a recording position;

forming an image on the intermediate medium using at least one color of ink; and transferring the image to a recording medium.

10. The method according to claim 9, wherein the step of establishing the amount of data to be printed comprises a step of reading a switch setting.

11. The method according to claim 10, wherein the step of reading a switch setting leads to a step of identifying increased image density directly related to an increase in the switch setting.

12. The method according to claim 9, wherein the step of establishing the amount of data to be printed comprises a step of calculating an amount of data to be printed.

13. The method according to claim 12, wherein, following calculating the amount of data to be printed, is a step of setting a drive pulse rate for release oil ejection.

14. The method according to claim 9, further comprising a step of separating the recording medium from the intermediate medium.

15. A printing apparatus using heat sensitive inks, comprising:

means for determining whether there is data to be printed;

means for establishing the amount of data to be printed;

means for moving an intermediate medium to a predetermined position;

means for ejecting release oil onto the intermediate medium as it transits to a recording position;

means for forming an image on the intermediate medium using at least one color of ink; and means for transferring the image to a recording medium.

16. The apparatus according to claim 15, wherein the means for establishing the amount of data to be printed comprises means for reading and using a switch setting establishing the amount of image data.

17. The apparatus according to claim 16, wherein the means for reading and using a switch data correlates an increased image density to an increase in the switch setting.

18. The apparatus according to claim 15, wherein the means for establishing the amount of data to be printed comprises means for calculating an amount of data to be printed.

19. The apparatus according to claim 18, wherein the means for establishing the amount of data to be printed, further comprises means for setting a drive pulse rate for release oil ejection based on the calculated amount of data to be printed.

20. The apparatus according to claim 15, further comprising means for separating the recording medium from the intermediate medium.

* * * * *